United States Patent [19]

Doan

[11] 4,145,302

[45] Mar. 20, 1979

[54] DETERGENT-CONTAINING CLEANSING ARTICLE

[75] Inventor: Robert B. Doan, Drexel Hill, Pa.

[73] Assignee: Atlantic Richfield Company, Los Angeles, Calif.

[21] Appl. No.: 909,881

[22] Filed: May 26, 1978

Related U.S. Application Data

[63] Continuation-in-part of Ser. No. 697,510, Jun. 18, 1976, abandoned.

[51] Int. Cl.[2] ..... C11D 1/37; C11D 17/04

[52] U.S. Cl. ..... 252/91; 15/104.93; 252/531; 252/535; 252/536; 252/539; 252/550; 252/554; 252/555; 252/558; 521/55; 521/121; 521/174

[58] Field of Search ..... 15/104.93; 252/90–92, 252/531, 535, 536, 539, 550, 554, 555, 558, DIG. 16; 401/49; 424/16; 260/2.5 A, 2.5 AG

[56] References Cited

U.S. PATENT DOCUMENTS

| | | | |
|---|---|---|---|
| 2,466,826 | 4/1949 | Romaine | 260/2.5 |
| 3,034,169 | 5/1962 | Vitale et al. | 252/91 X |
| 3,261,675 | 7/1966 | Cameron | 51/293 |
| 3,585,144 | 6/1971 | Schlitz et al. | 252/91 |
| 3,598,742 | 8/1971 | Jamison et al. | 252/91 |
| 3,719,596 | 3/1973 | Shore et al. | 252/1 |
| 3,788,999 | 1/1974 | Abler | 252/91 |
| 3,867,317 | 2/1975 | Woo | 252/555 |

*Primary Examiner*—P.E. Willis, Jr.
*Attorney, Agent, or Firm*—Coleman R. Reap

[57] ABSTRACT

Detergent pads having rapid detergent release and longer lasting detergency properties are presented. The detergent pads are made by incorporating into a suitable cleansing article capable of retaining dry detergent at least one sodium, lithium, potassium, ammonium or magnesium sulfonate or sulfate ester and at least one calcium or barium sulfonate or sulfate ester.

11 Claims, No Drawings

DETERGENT-CONTAINING CLEANSING ARTICLE

RELATED APPLICATIONS

This application is a Continuation-In-Part of U.S. application Ser. No. 697,510 filed on June 18, 1976, now abandoned.

BACKGROUND OF THE INVENTION

This invention relates to detergent-containing cleansing articles and, more particularly, to detergent pads having longer lasting detergency which are made from combinations of water-soluble sulfonates or sulfate esters and relatively water-insoluble sulfonates or sulfate esters.

U.S. Pat. No. 3,579,458 discloses compositions comprised of specific brighteners and neutralized acid solvents such as alkylbenzene sulfonic acids neutralized with a sodium base. The sodium base may be replaced in whole or in part with calcium or barium bases.

In efforts to satisfy consumer demand for convenience-type cleansing products, the cleansing products industry has developed cleansing pads which contain soap or detergent which is released during use of the pads in water. Detergent pads offer some advantages over soap pads, but they generally have the disadvantage of rapidly losing their detergent. The rapid exhaustion of detergent is due to the relatively high water-solubility of the detergents used in the pads. These detergents, usually organic sulfonic acid salts or sulfuric acid ester salts, are generally prepared by neutralizing the corresponding sulfonic acid or sulfuric acid esters with sodium, potassium or ammonium bases to produce rapid sudsing highly water-soluble salts.

Detergents made by neutralizing sulfonic acid or sulfuric acid esters with bases which produce water-insoluble salts, such as calcium or barium bases, are generally unsuitable for use as household cleansers because they have very poor detergency properties in water. It would be desirable to develop detergent pads which possess the excellent detergent properties of the above-described detergent pads and which retain their detergency properties for longer periods of time.

SUMMARY OF THE INVENTION

A detergent pad has now been discovered which has the desirable properties of rapid release of detergent and longer lasting detergency. Accordingly, it is an object of the invention to present improved detergent pads. It is another object of the invention to provide detergent pads having longer lasting detergency. It is another object of the invention to present detergent pads having both rapid detergent release and longer lasting detergency. These and other objects of the invention will become more apparent from the following description and examples.

The above objects are accomplished in detergent pads which have incorporated therein a mixture comprised of, as a first component, at least one sulfonic acid salt or sulfuric acid ester salt of lithium, sodium, potassium, ammonia and/or magnesium and, as a second component, at least one sulfonic acid salt or sulfuric acid ester salt of calcium or barium. The detergent pads preferably contain a cation equivalents ratio of said first component to said second component of about 100:1 to about 1:100 and most preferably about 1:10 to 10:1. The preferred anions are the linear alkylbenzene sulfonate radicals containing 10 to 14 alkyl carbon atoms.

DESCRIPTION OF THE INVENTION

The term "detergent pad" is used herein to denote the detergent-containing cleansing article constituting the invention. The cleansing article may be made of any desired material. Particularly suitable materials from which cleansing articles are commonly made include paper, synthetic or natural fabrics, synthetic or natural sponges, steel wool and other abrasive products made from metal strands or windings, abrasion resistant polymeric materials, bristles, etc. The cleansing article may have any desired form including flat sheets comprised of single or multiple layers, rolled pillows such as conventional steel wool pads, etc. The pads may also be formed from a combination of materials, for example, they may be made of a core of soft fabric enveloped in a close mesh woven abrasion-resistant polymeric material. It is preferred to use non-metallic materials in producing the pads because they do not rust and have better detergent-holding properties.

The pads desirably have the capability of holding considerable amounts of detergent. Pads having good detergent retention can be made by any desired method. They may be made simply by using absorbent paper or cloths, etc. made from swellable natural and synthetic fibers. Pads having good detergent retention can also be made by weaving or knitting strands of material into the desired shape thereby forming interstices through which the detergent can pass.

The detergent incorporated into the pad is comprised of a mixture containing at least one member from each of two groups of sulfonic acid or sulfuric acid ester salts. The first group comprises the sulfonic acid salts or sulfuric acid ester salts of lithium, sodium, potassium, ammonium and magnesium and the second group comprises the sulfonic acid salts or sulfuric acid ester salts of calcium and barium. More than one member from each group may be included in the detergent formulation if desired and such mixtures are useful where it is desired to modify the hydrophilic-hydrophobic properties of the detergent.

The equivalents ratio of total lithium, sodium, potassium, ammonium, and magnesium, sulfonic acid and sulfuric acid ester salts to total calcium and barium sulfonic acid and sulfuric acid ester salts is preferably in the range of about 1:100 to about 100:1 and most preferably in the range of about 1:10 to about 10:1.

The calcium and the barium salts of the sulfonic acids and sulfuric acid esters perform equally well in reducing the leachability of the detergent from the pads. The calcium salts are often preferred because of their lower cost. Although any of the lithium, sodium, potassium, ammonium and magnesium salts of the sulfonic acids and sulfuric acid esters can be used in the detergent composition incorporated into the pads, it is often preferable to use sodium, ammonium or magnesium salts and most often preferred to use the sodium salts because of their low cost and availability. As stated above, the detergent composition may contain salts of more than one cation from each group.

The detergent composition may be overbased, if desired, by adding up to about 150%, on an equivalent basis, of the stoichiometric amount of total base to the sulfonic acids and/or sulfuric acid esters being neutralized. In other words, the equivalents ratio of total base to total sulfonic acid and sulfuric acid ester can vary from about 1:1 to 1.5:1. Overbased detergents have better grease-cutting power. If the detergent pad is intended for use where it will come into physical contact with the person using it, it is preferred to overbase with bases and amounts of bases which will provide a detergent having a pH in the range of about 7 to 9. The excess base present in overbased detergents can be an oxide, hydroxide, carbonate or bicarbonate of lithium, sodium, potassium, ammonia, magnesium, calcium, barium or mixtures of two or more of these.

The organic sulfonic acid or sulfuric acid ester from which both detergent components are made can be any of those acids or acid esters from which detergents are generally produced. Among the sulfonic acids most commonly used are alkylaryl sulfonic acids, alpha-olefin sulfonic acids, and paraffin sulfonic acids. Among the sulfuric acid esters most commonly neutralized are primary alkyl sulfuric acid esters and secondary alkyl sulfuric acid esters.

The alkylaryl sulfonic acids most commonly used are the derivatives of benzene and naphthalene. Typical of alkylbenzene and alkylnaphthalene sulfonic acids are those in which the alkyl groups are linear or branched chain. They often have 1 to 3 alkyl groups attached to the benzene or naphthalene ring and the alkyl groups usually contain a total of about 8 to 20 and preferably about 9 to 16 carbon atoms. It is often desirable when there are two or more side chains on the benzene ring that one of the side chains contain a very few carbon atoms such as 1 to 3 carbon atoms. Typical alkylbenzene and alkylnaphthalene sulfonic acids include nonylbenzene sulfonic acid, dodecylbenzene sulfonic acid, hexadecylbenzene sulfonic acid, eicosylbenzene sulfonic acid, dodecyltoluene sulfonic acid, 4-dodecylnaphthalene-1,8 disulfonic acid, etc. Saturated aliphatic benzene sulfonic acids such as straight or branched chain alkylbenzene sulfonic acids in which the alkyl group has 10 to 14 carbon atoms are preferred sulfonic acids of this type. Commercial alkylbenzene sulfonic acids are often a mixture of several alkylbenzene sulfonic acids. For example, commercial dodecylbenzene sulfonic acid often contains 10 to 14 carbon atoms with an average carbon content of about 11.5 carbon atoms per alkyl group.

The alpha-olefin sulfonic acids most commonly used are those in which the alkene group is linear and has about 8 to 20 carbon atoms. These sulfonic acids are usually prepared by reacting a linear alpha-olefin with sulfur trioxide and the product usually contains, in addition to the alpha-olefin sulfonic acid, a hydroxyalkyl sulfonic acid. Typical alpha-olefin sulfonic acids include dodecenyl sulfonic acid, hexadecenyl sulfonic acid, eicosenyl sulfonic acid, etc.

The sulfuric acid esters most often used in the preparation of the neutralized sulfuric acid esters include primary and secondary alkyl sulfuric acid esters. Commonly used primary alkyl sulfuric acid esters are those in which the alkyl group contains about 8 to 20 carbon atoms with predominantly linear alkyl groups preferred. These compounds are often prepared by the reaction of a primary alcohol with sulfur trioxide and usually consists of compounds having a range of carbon atoms and may contain a mixture of isomers. Typical primary alkyl sulfates include: n-dodecyl alcohol sulfate, n-hexadecyl alcohol sulfate, tridecyl oxo alcohol sulfate, mixed n-primary and 2-methyl and 2-ethyl isomers of $C_{12}$ to $C_{15}$ alcohol sulfates, etc.

Commonly used secondary alkyl sulfuric acid esters are those in which the alkyl group contains about 8 to 20 carbon atoms. These compounds are generally prepared by the direct reaction of an olefin with sulfuric acid and usually consist of a mixture of isomeric sulfuric acid esters, i.e., the sulfuric acid radical is attached to various carbon atoms in the chain. Typical secondary alkyl sulfuric acid esters include 2-dodecyl sulfate, 3-tetradecyl sulfate, mixed secondary esters of $C_{12}$ to $C_{15}$ alcohol sulfates, etc.

The detergent can be incorporated in the pad by any desired method. Detergent-containing pads can be conveniently made by dipping the pads in an aqueous solution of the detergent until they become saturated with the detergent solution followed by oven drying the pads to remove the water. Another method of preparing the pads is to inject a more highly concentrated aqueous solution into the pad and then removing the water by drying. Another useful method is to pour dry detergent in flake or powder form into a pocket in the pad and closing the pocket by sewing, etc. A particularly useful method of incorporating the detergent into synthetic sponges made from expanded polymer, such as polyurethane, is to add anhydrous detergent to a polymerization formulation and then produce the desired foamed polymeric product by polymerization. This last method provides a method of incorporating detergent into the physical polymer structure, thereby providing a product which retains the detergent over long periods of time. The foregoing methods of incorporating detergent into pads are all commercially known and form no part of the invention.

The total amount of detergent composition incorporated into the detergent pad usually varies between about 0.5 to 50%, based on the total weight of the detergent pad, i.e., the weight of the pad, detergent composition, and other additives. It is preferred to incorporate about 5 to 25% and more preferably about 10 to 20%, based on the total weight of the detergent pad, of total detergent composition into the pad.

It may be desirable to include one or more lower alkylbenzene sulfonic acid salts in the detergent pad to improve the water solubility of the detergent. Suitable alkylbenzene sulfonic acid salts are those containing one to eight carbon atoms and having as cations one or more of sodium, ammonium, magnesium, calcium or barium ions. These lower alkylbenzene sulfonic acid salts can be added in amounts of up to about 10%, based on the total weight of the detergent-containing pad.

Other additives can be added to the detergent pads of the invention, if desired, in minor amounts to modify its functional properties or enhance its consumer appeal. Additives contemplated for inclusion into the detergent pads include perfumes; dyes; detergent builders, such as phosphate salts and alkanol amides; abrasives, such as fine clays like bentonite and talc; etc. The total amount of other additives usually does not exceed about 20% based on the total weight of the detergent pad.

The invention is further illustrated by the following examples in which parts and percentages are on a weight basis, unless otherwise specified.

EXAMPLE I

A

An aqueous detergent solution is prepared by mixing 100 gm of dry sodium dodecylbenzene sulfonate and 100 gm of dry calcium dodecylbenzene sulfonate to 400 cc of water. A weighed nylon scrubbing pad is immersed in the detergent solution until it is saturated with the solution. The nylon scrubbing pad is then placed in an oven and dried overnight at 150° C. The pad is weighed and found to have absorbed 40% of its weight of the detergent mixture on a dry basis.

B

A detergent pad is made in accordance with the procedure of Part A except that 200 gm of dry sodium dodecylbenzene sulfonate is substituted for the mixture of sodium dodecylbenzene sulfonate and calcium dodecylbenzene sulfonate. The dried pad contains the same total amount of detergent as the Part A pad.

When the pads prepared in Parts A and B are used to wash greasy pots and pans each pad will provide good sudsing, but the pad which contains a mixture of sodium and calcium dodecylbenzene sulfonates will have about a 20% longer useful detergent life than the pad which contains only sodium dodecylbenzene sulfonate.

EXAMPLE II

A concentrated aqueous detergent slurry is prepared by mixing 100 gm of dry sodium dodecylbenzene sulfonate and 100 gms of dry calcium dodecylbenzene sulfonate with 150 cc of water. A quantity of the detergent slurry is drawn into a syringe and injected into the center of a cleansing article comprised of a closely woven soft synthetic fabric center sewn into the pocket of a coarse-fiber knitted nylon pouch. The cleansing article is dried overnight in an oven set at 150° C. The resulting detergent pad contains about 35% by weight detergent and will have a long detergent-producing life.

EXAMPLE III

The procedure of Example II is repeated except that barium dodecylbenzene sulfonate is substituted for the calcium dodecylbenzene sulfonate, magnesium dodecylbenzene sulfonate is substituted for the sodium dodecylbenzene sulfonate and a steel wool pad is substituted for the knitted nylon pouch. The detergent is overbased by the incorporation therein of a sufficient quantity of magnesium hydroxide to adjust the pH of the detergent composition to 8.0. The resulting detergent pad will have excellent grease-cutting properties and a long detergent-producing life.

EXAMPLE IV

The procedure of Example I, Part A is repeated except that the calcium dodecylbenzene sulfonate is replaced with calcium n-dodecyl alcohol sulfate and the sodium dodecylbenzene sulfonate is replaced with sodium n-dodecyl alcohol sulfate. The resulting detergent pad will have a long detergent-producing life.

EXAMPLE V

The procedure of Example I, Part A is repeated except that the calcium dodecylbenzene sulfonate is replaced with calcium hexadecenyl sulfonate and the sodium dodecylbenzene sulfonate is replaced with potassium hexadecenyl sulfonate. The resulting detergent pad will have a long detergent-producing life.

EXAMPLE VI

The procedure of Example I, Part A is repeated except that the calcium dodecylbenzene sulfonate is replaced with barium 3-tetradecyl sulfate and the sodium dodecylbenzene sulfonate is replaced with sodium 3-tetradecyl sulfate. The resulting detergent pad will have a long detergent-producing life.

EXAMPLE VII

The procedure of Example I, Part A is repeated except that the sodium dodecylbenzene sulfonate is replaced with lithium dodecylbenzene sulfonate. The resulting detergent pad will have a long detergent-producing life.

EXAMPLE VIII

A foamed polyurethane detergent pad is made as follows:

To a 1000 cc beaker are added with continuous stirring 400 gms of propoxylated glycerol having a number average molecular weight of 3000 and containing 3 hydroxyl groups per molecule, 50 gms of dry sodium dodecylbenzene sulfonate, 50 gms of dry calcium dodecylbenzene sulfonate, 0.70 gm of 30% by weight solution of triethylene diamine in dipropylene glycol, 1.40 gms of stannous octoate, and 5.8 gms of commercial grade 2,4-toluene diisocyanate. The mixture is stirred for one minute, poured into cylindrical carton and cured at 100° C. for ½ hours. The resulting detergent pad has a density of about 14 lbs/cu ft. and will have a long detergent-producing life.

The foregoing examples illustrate various embodiments of the invention. Example I indicates that detergent pads made in accordance with the invention will produce suds for a considerably longer time than conventional detergent pads.

Although the invention has been described with particular reference to specific examples, it is understood that the invention is not limited thereto but is limited only by the scope of the appended claims.

I claim:

1. An improved detergent pad comprised of a porous cleansing article having incorporated therein a dry water-activated detergent mixture comprised of a first component selected from the organic sulfonic acid and sulfuric acid ester salts of lithium, sodium, potassium, ammonium, magnesium and mixtures of these and a second component selected from the organic sulfonic acid and sulfuric acid ester salts of calcium, barium, and mixtures of these, the sulfonic acid and sulfuric acid esters from which said first and second components are prepared containing about 8 to 20 total non-aromatic ring carbon atoms and being selected from the group consisting of alkylaryl sulfonic acids, alpha-olefin sulfonic acids, primary alkyl sulfuric acid esters, secondary alkyl sulfuric acid esters, and mixtures of these, the cation equivalents ratio of said first and second components being about 10:1 to 1:10, and the total amount of said first and second components in said detergent pad being about 0.5 to 50%, based on the total weight of the detergent-containing pad.

2. The improved detergent pad of claim 1 wherein the sulfonic acid or sulfuric acid ester is an alkylaryl sulfonic acid having 8 to 20 alkyl carbon atoms.

3. The improved detergent pad of claim 2 wherein said alkylaryl sulfonic acid is alkylbenzene sulfonic acid having 10 to 14 total alkyl carbon atoms.

4. The improved detergent pad of claim 1 wherein the cation of said first component is selected from sodium, ammonium ion, magnesium and mixtures of these.

5. The improved detergent pad of claim 1 wherein the total amount of said first and second components in the detergent pad is about 5 to 25%, based on the total weight of the detergent-containing pad.

6. The improved detergent pad of claim 1 wherein the detergent mixture contains up to about 50 equivalent % excess base selected from the group consisting of the oxides, hydroxides, carbonates and bicarbonates of lithium, sodium, potassium, ammonia, magnesium, calcium, barium and mixture of these.

7. The improved detergent pad of claim 1 wherein said cleansing article is non-metallic.

8. The improved detergent pad of claim 1 wherein said cleansing article is polyurethane foam and the detergent mixture is incorporated into the polymerization formulation prior to polymerization.

9. The improved detergent-containing pad of claim 1 wherein the cleansing article contains up to about 10%, based on the total weight of the detergent-containing pad, of at least one linear alkylbenzene sulfonic acid salt of sodium, ammonium, magnesium, calcium, or barium having 1 to 8 total alkyl carbon atoms.

10. An improved detergent-containing pad comprised of a non-metallic cleansing article having incorporated therein about 5 to 25% based on the total weight of the detergent-containing pad of a mixture comprised of, as a first component, at least one sodium, ammonium or magnesium salt of an alkylbenzene sulfonic acid having about 10 to 14 total alkyl carbon atoms and, as a second component, at least one calcium or barium salt of an alkylbenzene sulfonic acid having about 10 to 14 total alkyl carbon atoms, the cation equivalents ratio of said first component to said second component being in the range of about 10:1 to 1:10.

11. The improved detergent-containing pad of claim 10 wherein the alkylbenzene sulfonic acid used in the preparation of said first and second components is commercial grade dodecylbenzene sulfonic acid and the total amount of said first and second components present in said cleansing article is about 10 to 20% based on the total weight of the detergent-containing pad.

* * * * *